US005201340A

United States Patent [19]

Teepe

[11] Patent Number: 5,201,340

[45] Date of Patent: Apr. 13, 1993

[54] AUTOMATIC DRAINAGE DEVICE FOR CARGO CONTAINERS

[75] Inventor: Stephen Teepe, Celle, Fed. Rep. of Germany

[73] Assignee: Graaff, GmbH, Elze, Fed. Rep. of Germany

[21] Appl. No.: 844,841

[22] Filed: Mar. 3, 1992

[51] Int. Cl.[5] ..... F16K 31/22; F16K 33/00; F16K 43/00

[52] U.S. Cl. ..... 137/315; 4/287; 137/397; 137/433

[58] Field of Search ..... 137/192, 397, 398, 430, 137/433, 449, 395, 396, 399; 4/287, 682, 688, 689

[56] References Cited

U.S. PATENT DOCUMENTS

| | | | |
|---|---|---|---|
| 914,418 | 3/1909 | Hutchins | 137/398 |
| 921,865 | 5/1909 | Miller et al. | 137/398 |
| 1,623,515 | 4/1927 | Workman | 137/433 |
| 1,982,555 | 11/1934 | Van Der Horst | 137/433 |
| 2,199,673 | 5/1940 | Ronning | 137/433 |
| 2,787,376 | 4/1957 | Coulson | 137/433 |
| 2,972,412 | 2/1961 | Lundeen | 137/192 |
| 3,759,281 | 9/1973 | Falcuta | 137/433 |
| 4,132,238 | 1/1979 | Clark | 137/433 |
| 4,742,842 | 5/1988 | Garneau et al. | 137/192 |

*Primary Examiner*—George L. Walton
*Attorney, Agent, or Firm*—Fiddler Levine & Mandelbaum

[57] ABSTRACT

The present innovation pertains to a device with which containers, in which water collects in an unintentional manner, are automatically drained. An outer housing (2, 3), which can be inserted into the bottom of the container, is subdivided by a web (8*a*) into two chambers, one of which is connected to the interior of the container, and the other of which is connected to the surroundings of the container. The web encloses an opening (20) which connects the two chambers when a valve member (14) has moved away from a seat (8*b*) enclosing the opening. If the valve member rests on the seat, the chambers are separated from one another, and the interior space of the container is not in connection with the surroundings of the container. The movement of the valve member is controlled by the water level in the chamber which is in connection with the interior space of the container.

13 Claims, 1 Drawing Sheet

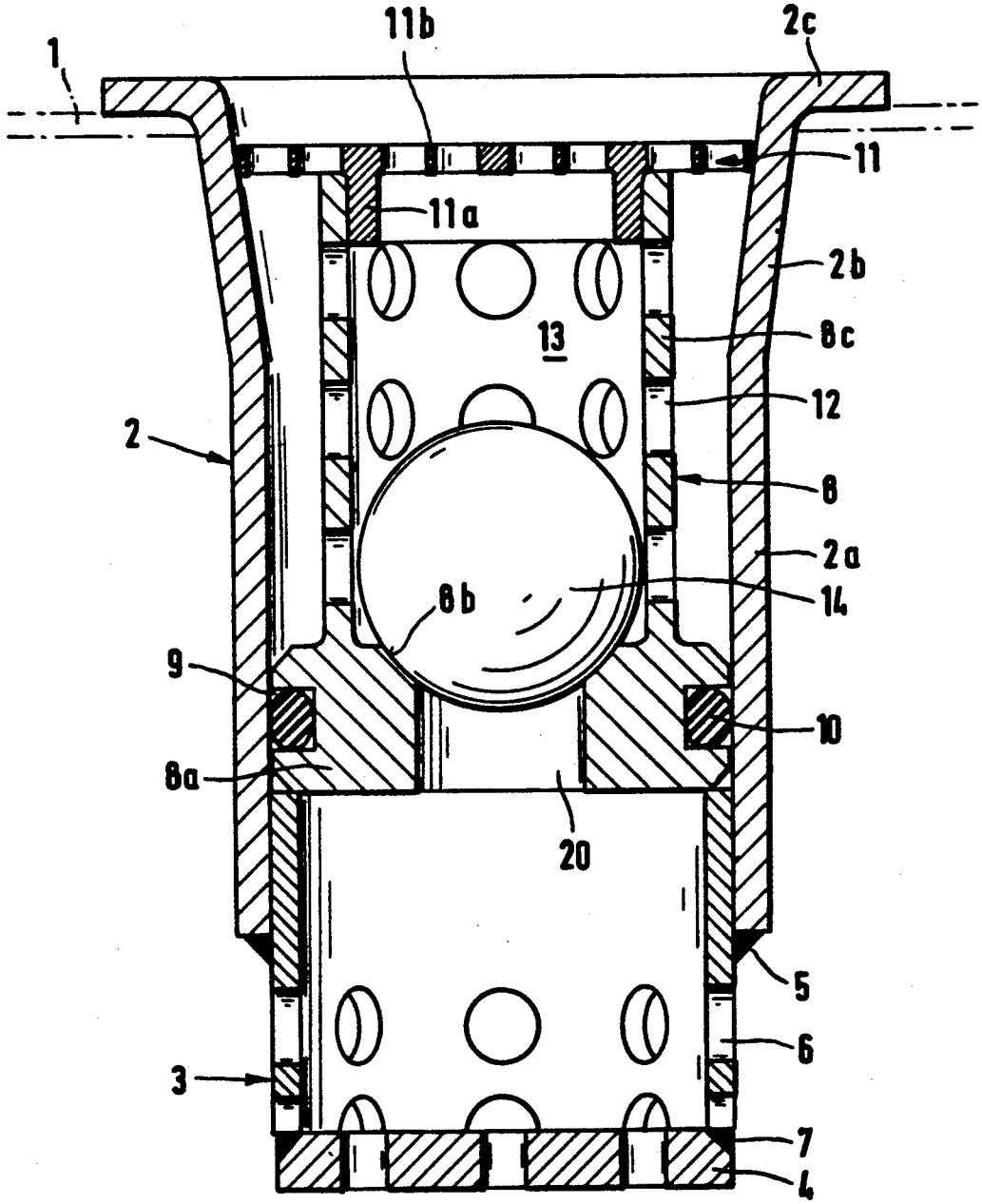
1
11b
2c
11
11a
2b
13
8c
12
2
8
2a
14
8b
9
10
8a
20
5
6
3
7
4

AUTOMATIC DRAINAGE DEVICE FOR CARGO CONTAINERS

In connection with containers, one is frequently faced with the problem of having to remove water collecting inside them. For example, during the transportation of fruits in a closed container, so much perspiration water and/or condensation water is formed, even if the container is air-conditioned, that it becomes necessary in the case of prolonged transportation to remove the perspiration and/or condensation water during transportation. This is a known problem, and various solutions to the problem have been suggested in container technology.

The present innovation suggests a device for automatically draining such containers, which has a number of advantages. The device operates trouble-free, especially during operating times of practically any length; it is easy to produce and to be associated with the container in question, and it guarantees that the amount of water accumulating in the container during operating times of practically any length, will not exceed an acceptable maximum, and that this water will also accumulate in an area in which transported goods are not normally present.

The essential features of the present innovation will become apparent from the specification and the patent claims.

The present innovation will be specifically described below on the basis of the drawing, which shows a central longitudinal section of an automatically operating drainage device according to the present innovation.

The device according to the present innovation is a structural unit which can be associated as such in a simple manner with basically any container such that it is inserted into the bottom of the container and, passing through the bottom of the container, projects from the container in the downward direction. Consequently, the bottom of the container is illustrated in the drawing by the dash-dotted line 1 only symbolically.

The device has an outer housing which is composed of an outer housing upper part 2 and an outer housing lower part 3. Both the said upper part 2 and the said lower part 3 are pipes, wherein the lower part is a smooth pipe of constant cross section over its entire length, which is open at the end which is identified as the upper end facing the said upper part 2 in the installed state, and has a lid 4 at the other end that is identified as the lower end is the installed state and faces away from the upper part. Again with reference to the installed state, the said upper part 2 is likewise a smooth pipe section **2*a* of constant cross section in the longer, lower area facing the said lower part 3. A pipe section 2*b* expanding in a funnel-shaped manner, which ends at the upper, wider end in a downwardly directed fastening flange 2*c*, is placed on the top of the said pipe section 2*a*. The internal cross section of the said smooth pipe section 2*a* is so much larger than the outer cross section of the said lower pipe 3 that the said lower part 3 of the outer housing can be coaxially introduced into the said upper part 2 of the outer housing by a certain amount from below, the said lower part 3 of the outer housing is located in the said upper part 2 of the outer housing without clearance after being introduced into the said upper part 2 of the outer housing, and the two parts of the outer housing form, as a unit, the outer housing of the drainage device after a weld seam 5** is prepared.

With this outer housing, the device can be introduced into a corresponding opening in the bottom of the container from the top until the outer housing comes to lie, with the underside of the radial flange **2*c*, on the top side of the said container bottom 1**, and it is ensured, by means of suitable fastening means and using suitable sealing means, that the device is associated with the container in an immobile manner and without leaks.

In the part of the said lower part 3 of the outer housing outside the said upper part 2 of the outer housing, the pipe wall is provided with holes 6, and the lid 4 welded (weld seam 7) to the pipe forming the said lower part 3 of the outer housing is also provided with such holes. The said holes 6 are arranged in an advantageous pattern in both the said pipe 3 and the said lid 4. In the said pipe 3, the said holes form two rows, which are located at spaced locations from each other in the longitudinal direction, and the holes are spaced uniformly [from each other] within each row extending in the circumferential direction of the pipe. The holes of the row located closer to the lower pipe end are arranged such that the horizontal diameters are located in the plane of the pipe end, so that a regularly perforated circumferential edge is formed. A hole 6 is arranged concentrically in the said lid 4, and a plurality of such holes 6 are arranged around this hole on a circle located close to the outer circumference of the lid and at equally spaced locations from one another.

A valve cage 8 is introduced into the said upper part 2 of the outer housing from the top end. The said valve cage has a cylindrical foot **8*a* having a web portion with a central passage opening 20, whose outer diameter corresponds to the internal diameter of the said upper part 2 of the outer housing in the said smooth section 2*a*, whose upper internal circumference forms a valve seat 8*b* enclosing the said opening 20. A circumferential groove 9, which accommodates a sealing ring 10 that is located, pre-tensioned, between the walls of the said groove 9 that is open to the outside and the inner wall of the said section 2*a* of the said upper part 2 of the outer housing, is provided in the outer circumference of the said foot 8*a*. With its lower front side, the said valve cage 8 lies on the upper front side of the said lower part 3 of the outer housing. The cylindrical section 8*c* of the said valve cage 8, whose external and internal diameters remain constant over the entire length, adjoins the said foot 8*a* in the upward direction between the outer and inner edges. A lid 11 is inserted into the said valve cage 8 into the top end without clearance, and [the said lid 11] is in contact, with the outer circumference of a short, cylindrical section 11*a*, with the inner wall of the said section 8*c* of the said valve cage 8 with a slight press fit, and lies, with the underside of the radially located flange or bottom 11*b*, on the upper front side of the said cylindrical section 8*a* of the said valve cage 8. With the lower edge of the outer circumferential surface of the said flange 11*b*, the said lid 11 of the said valve cage 8 lies on the inner surface of the said funnel-shaped expansion 2*b* of the said upper part 2 of the outer housing, wherein the top side of the said flange 11*b* is located, to a predetermined extent, below the said radial flange 2*c*** of the outer housing.

The said cylindrical section **8*a* of the said valve cage 8 is provided with holes 12, which have approximately at least the same area as the said holes 6 and are arranged in three circumferential rows located at approximately equally spaced locations from one another, at equally spaced locations from one another within each row. Such holes are also associated with the said bottom or flange 11***b* of the said lid 11, arranged at equally spaced locations in two concentric rows within the said section 11*a*, and in two concentric rows in the flange part outside the said section 11*a*, and the circumstance that the holes of the inner row in the flange part outside the said section 11*a* are partially covered by the upper front side of the said cylindrical section 8*c* of the said valve cage 8 is harmless.

A floatable valve member 14 acting as a closing member, which has the shape of a ball and whose lower end position is determined by the said valve seat 8*b*, and whose upper end position is determined by the said bottom 11*b* of the said lid 11 of the said valve cage 8, is located in the chamber 13 enclosed by the said valve cage 8.

The said outer housing 2, 3 with its said lid 4, and the said valve cage 8 with its said lid 11 usually consist of a stainless metal, even though a plastic is not ruled out, either. The said valve member 14 consists of a material which guarantees resting of the said valve member 14 on the said valve seat when it is surrounded by air, but which guarantees that the said valve member 14 will float up and be lifted off from the said valve seat 8*b* when the said valve member is surrounded by water from below to a predetermined extent.

If the drainage device according to the present innovation is associated with a container, and no water is present in the container, the said valve member 14 rests on the said valve seat 8*b*, and contours and the bearing pressure seal off the interior space of the container and the surroundings of the container against each other, and the possibility of air conditioning the interior space of the container is not impaired if the container is otherwise airtight. If perspiration water begins to form in the container, this water enters the said outer housing 2, 3, collects above the said sealing ring 10, and is uniformly distributed in the said interior space 13 enclosed by the said valve cage 8 and the annular space between the said valve cage and the said outer housing. Even though the bearing pressure with which the said valve member 14 is kept in contact with the said valve seat 8*b* decreases with increasing entry of liquid, this is harmless, because the water surrounding the contact area acts like a seal.

However, once the water level in the aforementioned areas of the device has reached a defined value, buoyancy causes the said valve member 14 to be lifted off from the said valve seat 8*b*, and the water accumulated is able to flow off to the outside, until the initial state is reached, i.e., the said valve member 14 again comes to lie on the said valve seat 8*b*.

The device can be assembled from simple parts and can be installed in a simple manner, i.e., it entails low production and installation costs. It has practically no expendable parts, i.e., it is able to operate reliably over a long time of operation. It is easy to clean by introducing from below a powerful jet of water that is able to loosen and flush out contaminants that may have collected. For more intense cleaning, the said valve cage 8 with the said lid 11 and the said valve member 14 can be disassembled by simply pulling it out of the said outer housing.

The said lid 11 provided with holes allows the water to be removed from the container to flow into the valve chamber via the said web 8*a*, but otherwise, acting as a screen, it keeps coarser dirt particles from the inside of the container away from the area of interaction between the said valve seat 8*b* and the said valve member 14. Correspondingly, the said holes 6 in the lower end of the housing permit the water to be removed from the container to flow out, but, acting as a screen, they prevent dirt particles from the surroundings of the container to enter the area of interaction between the said valve seat 8*b* and the said valve member 14.

For the installed state, the object of the present innovation can be characterized in the form of claims and with its essential features.

An outer housing (2, 3), which can be inserted into the bottom of a container, is subdivided by a web (8*a*) into two chambers, one of which is connected to the inside of the container, and the other of which is connected to the surroundings of the container. The said web encloses an opening (20) that connects the two chambers to one another when a vaive member (14) has moved away from a seat (8*b*) enclosing the opening. If the valve member rests on the seat, the chambers are separated from one another, and the interior space of the container is not in connection with the surroundings of the container. The movement of the valve member is controlled by the water level in the chamber which is in connection with the interior space of the container.

The device is used to automatically drain containers. Its specific features become apparent from the following claims.

I claim:

1. An automatic drainage device for a cargo container comprising an essentially cylindrical outer housing with open upper and lower sections each having respective upper and lower ends and the upper end of the lower section being disposed within the upper section, a web mounted in the housing between the upper end of the upper section and the lower end of the lower section and having a passage opening, a floatable closing member removably seated on the upper side of the web for sealing the passage opening, and a valve cage in the upper section having a foot mounted and supported on the upper end of the lower section, the foot comprising the web, whereby the entire drainage device can be easily inserted in and removed from the container as a single unit.

2. A drainage device in accordance with claim 1, wherein the foot of the valve cage is in clearance-free contact with the inner wall of the upper section of the housing and surrounds the passage opening, and the valve cage comprises an upwardly directed cylindrical section, there being defined between the valve cage upwardly directed cylindrical section and the upper section of the outer housing an annular space that is open toward the upper end of the housing.

3. A drainage device in accordance with claim 2 further comprising a lid enclosing the upper end of the valve cage, the lid and the cylindrical section of the valve cage having apertures.

4. A drainage device in accordance with claim 3, wherein the upper housing section has a funnel shaped portion, and the lid has a cylindrical section in contact with the inner wall of the cylindrical section of the valve cage, and an edge in contact with the inner wall of the funnel-shaped portion of the upper section of the housing.

5. A drainage device in accordance with claim 1 wherein the valve cage has an annular groove, and further comprising a sealing ring disposed in the groove, the sealing ring being in contact with the inner wall of the housing.

6. A drainage device in accordance with claim 5 wherein the housing has a securing flange at its upper end.

7. A drainage device in accordance with claim 6 wherein the housing comprises two parts securely connected to one another.

8. A drainage device in accordance with claim 7 wherein the upper end of the housing has a free pipe end.

9. A drainage device in accordance with claim 8 wherein the lower end of the housing comprises an apertured pipe wall.

10. A drainage device in accordance with claim 9 further comprising a plate mounted on and covering the lower end of the housing.

11. A drainage device in accordance with claim 10 wherein the plate is perforated.

12. A drainage device in accordance with claim 10 wherein the plate is secured to the housing.

13. A drainage device in accordance with claim 12 wherein the upper section of the housing comprises a pipe, and the lower section of the housing comprises a pipe narrower than the upper section pipe, the lower section of the housing being forced into the upper section of the housing from the lower end, whereby the lower section outer wall is in clearance-free contact with the inner wall of the upper section and the two housing sections are securely connected to one another.

* * * * *